United States Patent [19]

Eckhardt

[11] Patent Number: 4,783,081

[45] Date of Patent: Nov. 8, 1988

[54] PLAYING OR GAMES BOARD ON WHICH SEVERAL GAMES CAN BE PLAYED

[76] Inventor: Albert H. Eckhardt, Dellenpartkweg 5, 8161 AP Epe, Netherlands

[21] Appl. No.: 20,543

[22] Filed: Mar. 2, 1987

[30] Foreign Application Priority Data

Mar. 5, 1986 [NL] Netherlands ..... 8600561

[51] Int. Cl.[4] ..... A63F 3/00

[52] U.S. Cl. ..... 273/281; 273/284; 40/447

[58] Field of Search ..... 273/281, 284, 289, 291, 273/155; 434/166–176; 40/447, 484, 503–505, 530, 536, 537, 594–596, 618, 622; 446/389, 392, 469, 104

[56] References Cited

U.S. PATENT DOCUMENTS

| | | | |
|---|---|---|---|
| 1,752,251 | 3/1930 | Giroux | 273/281 X |
| 2,628,838 | 2/1953 | Smalley | 273/281 X |
| 3,410,011 | 11/1968 | Bowman | 273/281 X |
| 3,462,857 | 8/1969 | Glass et al. | 273/155 |
| 3,599,977 | 8/1971 | Glass et al. | 273/281 X |
| 4,090,322 | 5/1978 | Hake | 446/104 |

FOREIGN PATENT DOCUMENTS

| | | | |
|---|---|---|---|
| 647975 | 12/1928 | France . | |
| 2335128 | 12/1976 | France . | |
| 2516804 | 11/1981 | France . | |
| 0051234 | 4/1977 | Japan | 273/281 |
| 3221 | of 1891 | United Kingdom | 273/281 |

*Primary Examiner*—Richard C. Pinkham
*Assistant Examiner*—Jessica J. Harrison
*Attorney, Agent, or Firm*—Lucas & Just

[57] ABSTRACT

Playing or games board on whcih several games or the like can be played has a skeleton or framework which consists of a base with upright walls at the sides. Between these side walls a number of parallel upright partitions are placed. These partitions are joined perpendicularly at the top by narrow bars so that the upper face of the game board is divided into squares defined by the partitions and narrow bars. Into this framework of squares a number of bodies are rotatably fixed. The bodies are fixed so as to be rotatable about an axis of rotation, without communication between the bodies and each element or body has a number of faces directed outward which can be mutually changed in position by rotation of the body. Each face of an element has a different image or picture or the same image but of a different color. In one embodiment of the games board, any cross section through an element parallel to the axis of rotation is rectangular and any cross section perpendicular to the axis of rotation is an isosceles triangle.

5 Claims, 3 Drawing Sheets

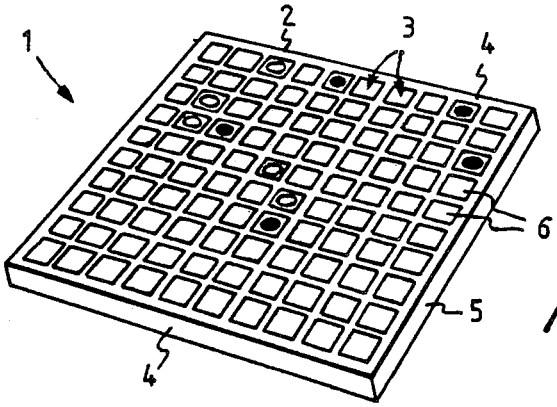
Fig. 1
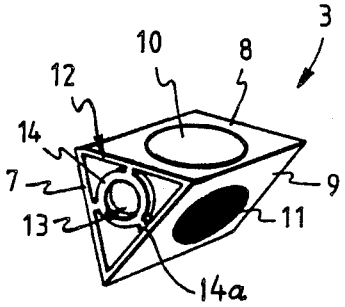
Fig. 2
Fig. 3
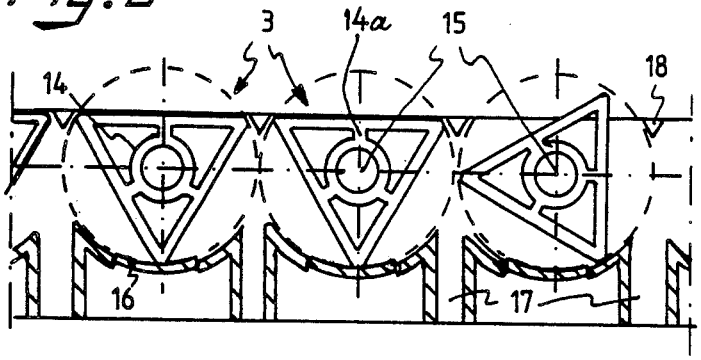

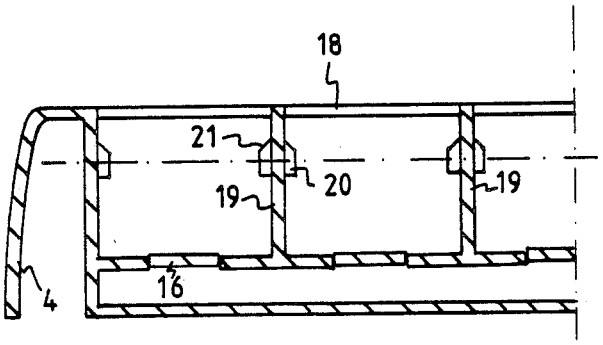
Fig: 4
Fig: 5
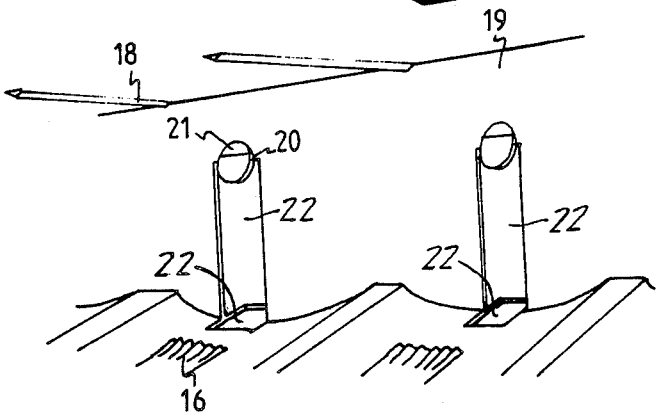

PLAYING OR GAMES BOARD ON WHICH SEVERAL GAMES CAN BE PLAYED

BACKGROUND OF THE INVENTION

The invention relates to a game board or playing board on which several games can be played. Playing boards, such as draughts boards, chess boards, the playing board for halma and the like, on which one game can be played, are generally known. Playing boards are also in fact known on which several games can be pursued. For this purpose, the playing face is provided with a number of lines within which the desired game can be pursued. All these games consist of a board with a number of playing pieces which can be moved on the playing board. Such games or the like can be pursued on a flat base and the movement has to be horizontal.

SUMMARY OF THE INVENTION

The subject of the invention is a games board which can serve to make it possible to pursue several games or the like on it and for which, in principle, no loose playing pieces are needed and in which it is possible at the same time to indicate the face on which a particular playing piece should be placed.

The object of the invention is achieved by a playing or games board in that the playing board consists of a skeleton or framework in which a number of bodies or elements are fixed so as to be rotatable about an axis of rotation, and each element has a number of faces directed outwards which can mutually change position by rotation of the element about its axis of rotation and each face of an element has a different image or picture. Preferably, the elements are provided with a base colour which is different from the base colour of the element which directly adjoins them and one face is plainly coloured and the other faces are provided with the same image, for example a disc or triangle, which varies in colour from face to face for the same element. As a result of this it is possible to display the pattern-free face or a face on which an image, for example of a disc, has been made. Because any cross section through an element parallel to the axis of rotation is rectangular and any cross section perpendicular to the axis of rotation is triangular, it is possible to direct a pattern-free face upwards or to replace said pattern-free face by a face with an image of a particular colour, or an image of a different colour. It will very readily be possible to pursue the draughts game on such a board if the games board comprises sufficient elements. It is also possible to pursue other games which require a smaller area of the playing surface on such a games board.

It would also be possible to use elements of which any cross section perpendicular to the axis of rotation is a regular polygon. This would make it possible to work with still more coloured images. The preferred embodiment according to the invention consists of an element of which any cross section perpendicular to the axis of rotation is a triangle.

Preferably, the games board is constructed from a skeleton or framework which consists of a base with upright walls at the side and, parallel to one of the upright walls, upright partitions at an equal distance from each other, and the partitions are joined to each other by narrow bars so that the upper face is divided into squares by the partitions and the narrow bars. Using each square to accomodate an element which is clamped rotatably between the upright walls, with it being possible to rotate each element in a manner such that one of the side faces of the element can almost completely fill a square of the skeleton or framework and the axes of rotation of the elements are all parallel to each other, achieves the result that, if one element is rotated about its axis, it can rotate freely and is not impeded by other elements. So that the elements be placed sufficiently close together, there need be no partitions between the elements in the direction perpendicular to the axes of rotation. As a result of this, when turning, any element can make use of the volume beneath the adjacent square.

The invention will be explained in more detail with reference to the accompanying drawings.

DESCRIPTION OF THE DRAWINGS

FIG. 1 shows a view of the games board according to the invention;

FIG. 2 shows a view of an element;

FIG. 3 shows a side view of a few elements and a portion of the games board in cross section;

FIG. 4 shows a portion of a games board in cross section;

FIG. 5 shows an interior view of a portion of a games board;

DESCRIPTION OF THE PREFERRED EMBODIMENTS

Figure 6:
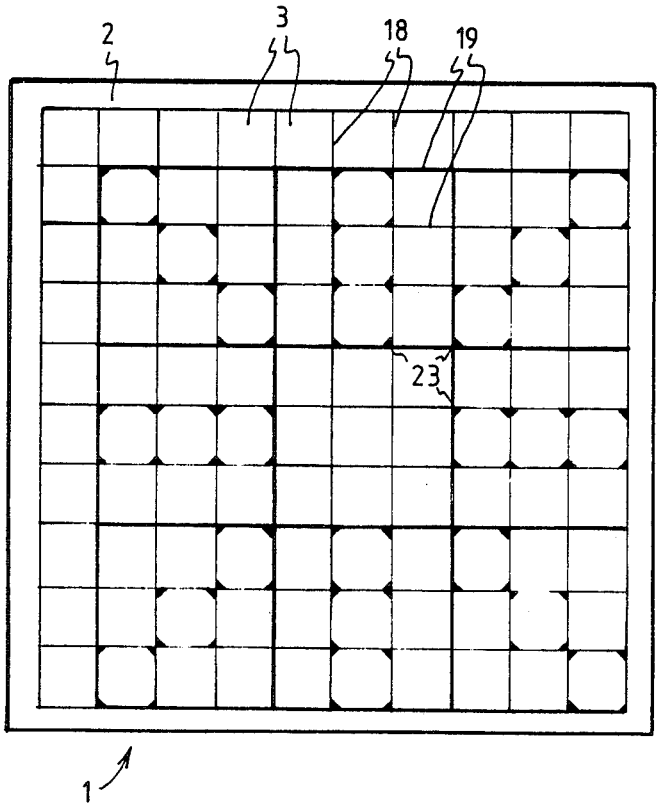
FIG. 6 shows a plan view of the playing face of a games board according to the invention.

FIG. 1 shows a view of a games board 1 according to the invention. The board consists of a frame 2 with a number of elements 3 in it which can be rotated so that other faces of the element are displayed. The framework or skeleton 2 has a number of side walls 4,5 and the upper face is divided into a number of squares 6.

FIG. 2 shows a view of an element 3. In the preferred embodiment each element has three square side faces 7,8,9. Each element has a base colour which can vary mutually from element to element. In the preferred embodiment of the games board according to the invention two base colours are used, the adjacent elements always varying in colour in accordance with a chess board or a draughts board. One face of each element is always entirely in the base colour and the other faces are provided with an image, such as, in this case, of a circle, which more or less resembles a draughtsman. In this embodiment the upper face 8 is provided of a circle 10 having a white face, the front face 9 is provided with a circle 11 having a black face, while the rear face 7, which is not visible here, is of even colour and not therefore provided with an image. The triangular side faces 12 of each element 3 have a hole 13 around the centre of gravity of the geometrical figure. In order to make the elements 3 as light in weight as possible, they are preferably as hollow as possible inside. For this purpose, around the central cavity or hole 13 there is a cylinder 14 which is joined to the side faces 7,8,9 by reinforcing elements 14*a*.

FIG. 3 shows a portion of a games board 1 in cross section with three elements 3 which can be rotated about the central axis 15. In the framework, beneath the central axis 15, there is a portion 16 which is partly detached from the framework 2 and which can yield slightly elastically. As a result of this the elements 3 are to some extent held firmly if the point of an element 3 is directed downwards. This is the position in which one of the faces of an element is situated in the playing face of the games board. The base of the framework 2 of the games board is provided with a number of holes or slots 17 which correspond to one of the bars 18. There should in fact be no walls provided between the rotatable elements since the elements cannot then be rotated or have to be placed too far apart.

FIGS. 4 and 5 show a detail of the framework 2 in cross section. Between the side walls 4 of the framework 2 of the games board there is provided a number of partitions 19 which are parallel to each other and at equal distances from each other. Said side walls are provided with projections 20 between which the elements 3 can be clamped by means of their triangular side faces 12. The projections are cylindrical and the upper side is to some extent flattened. Said flat 21 serves to make it easy to press the elements into the frame. The side walls are joined together by bars 18. FIG. 5 is more a view of the frame 2 from inside. The partitions 19 are provided with a number of holes 22 whose purpose is to make it possible to produce the hole frame more easily in one go in a jig. As a result of this, it is possible to approach the projections 20 both from below and from above by means of a press tool.

FIG. 6 shows a plan view of a games board according to the invention. A number of separations or partitions can be constructed somewhat more thickly, as can a number of bars. This produces a number of line figures. This facilitates the playing of games in which only a portion of the board is used. The elements themselves can, in addition, also be provided with additional markings, for example a small coloured triangle at the corners of the squares (indicated by the numeral 23).

Additionally, the game board according to the present invention can have each edge 18 between two squares (3) with a color which may be different from another edge or may correspond to another edge so that several figures are produced in a particular game, such as draughts or naughts and cross or the like.

Using the games board according to the invention it is possible to play a large number of known games, such as solitaire, halma, five in a row, and draughts in which a crowned man, for example, can be indicated by turning the point of an element upwards, with an adjacent pattern-free face and a face having the player's colour. The great advantage of the games board according to the invention is that no loose pieces are required to be able to pursue very many games. It is also possible to use the board to occupy children. They can produce all kinds of figures. It can also be used to play new games. For example, an attempt can be made to provide as many faces as possible with a certain symbol, no two symbols occurring on a horizontal line, on a vertical line or on a line at 45°. In addition, still more games can be pursued on such a board if use is made of loose components, such as counters, pawns or the like. The board might possibly also be used to solve multiple choice problems. Even blind people can make use of such a games board as a result of the square faces of the elements being provided with a relief. Because it is possible to play without making use of loose components, such a games board is also ideal for use in hospitals, it being possible for people confined to bed to pass the game on easily without the arrangement being changed. In addition, the games board can be held upside down and the arrangement then studied.

What is claimed is:

1. A game board, comprising a substantially rectangular framework in which a plurality of elements are arranged in rows and columns so as to be rotatable about a plurality of axes of rotation which are parallel to one another, each of said elements having at least three playing faces of mutually different appearance, each of said playing faces capable of being directed outwards by rotation of said elements, said framework comprising at least one pair of parallel upright walls, between and parallel to said walls a plurality of upright partitions, equal in number to the number of rows of said elements minus one, said walls and said partitions being joined together near the top by narrow cross bar equal in number to the number of columns of said elements minus one so that the top plane of the board is divided by said partitions and said bars into rectangles, each of said rectangles accommodating one of said elements, each of said walls and each of said partitions being provided with a plurality of projections such that in each of said rectangles a pair of projections are situated such that said pair of projections face each other, and each of said elements being provided with a central cavity in each of the opposite side faces thereof for engagement and cooperation with said pair of said projections so as to provide for the rotatability of said elements.

2. The game board of claim 1 wherein substantially one-half of said elements has one base color on each of said playing faces and the other half of said elements has another base color on each of said playing faces such that in each of said rows and in each of said columns, elements of one base color are arranged alternating with elements of the other base color.

3. The game board of claim 1 further comprising ten rows and ten columns of said elements, and wherein substantially one-half of said elements has one base color on each of said playing faces and the other half of said elements has another base color on each of said playing faces such that in each of said rows and in each of said columns, elements of one base color are arranged alternating with elements of the other base color.

4. The game board of claim 1 further comprising ten rows and ten columns of said elements, wherein substantially one-half of said elements has one base color on each of said playing base color on each of said playing faces such that in each of said rows and in each of said columns, elements of one base color are arranged alternating with elements of the other base color and wherein said cross bars and the tops of said partitions in sections between successive cross bars have colors which are different from each other so that several outlines are produced within which particular games can be played.

5. The game board of claim 1 further comprising ten rows and ten columns of said elements, wherein substantially one-half of said elements has one base color on each of said playing faces and the other half of said elements has another base color on each of said playing faces such that in each of said rows and in each of said columns, elements of one base color are arranged alternating with elements of the other base color and wherein said cross bars and the tops of said partitions in sections between successive cross bars have colors which correspond to each other so that several outlines are produced within which particular games can be played.

* * * * *

UNITED STATES PATENT AND TRADEMARK OFFICE

CERTIFICATE OF CORRECTION

PATENT NO. : 4,783,081

DATED : November 8, 1988

INVENTOR(S) : Albert H. Eckhardt

It is certified that error appears in the above-identified patent and that said Letters Patent are hereby corrected as shown below:

In the Abstract, line 1, change "whcih" to --which--.

Column 4, line 14, change "bar" to --bars--; line 45, before "base" insert --faces and the other half of said elements has another--.

Signed and Sealed this

Twenty-eighth Day of March, 1989

*Attest:*

DONALD J. QUIGG

*Attesting Officer*

*Commissioner of Patents and Trademarks*